United States Patent [19]

Thieke

[11] Patent Number: 4,705,165

[45] Date of Patent: Nov. 10, 1987

[54] SNUFF HOLDER AND DISPENSER

[76] Inventor: Michael D. Thieke, 6163 Lacewood Cv., Memphis, Tenn. 38115

[21] Appl. No.: 781,740

[22] Filed: Sep. 30, 1985

[51] Int. Cl.[4] ..... B65D 85/10

[52] U.S. Cl. ..... 206/253; 206/242; 206/249; 131/111

[58] Field of Search ..... 206/242, 249, 253, 255, 206/265, 267; 220/212, 281, 353, 352; 100/250; 131/111, 112, 119

[56] References Cited

U.S. PATENT DOCUMENTS

| | | | |
|---|---|---|---|
| 216,265 | 6/1879 | Ford | 131/119 |
| 918,519 | 4/1909 | Eberhart | 206/267 |
| 1,047,269 | 12/1912 | Miller | 206/255 |
| 1,063,066 | 5/1913 | Robinson | 206/253 |
| 1,221,896 | 4/1917 | Page | 206/267 |
| 1,476,652 | 12/1923 | Shore | 206/249 |
| 1,815,069 | 7/1931 | Petro | 206/267 |
| 1,935,840 | 11/1933 | Fitzgerald | 206/267 |
| 1,946,845 | 2/1934 | Fisher | 206/267 |
| 2,012,033 | 8/1935 | Atwater et al. | 206/267 |
| 2,090,530 | 8/1937 | Guffey et al. | 206/255 |
| 2,158,928 | 5/1939 | Deich | 131/111 |
| 2,303,167 | 11/1942 | Loether | 206/253 |
| 2,716,484 | 8/1955 | Weppler | 206/267 |
| 3,524,535 | 8/1970 | Dundore | 206/253 |
| 3,570,659 | 3/1971 | Richey | 206/253 |
| 3,580,166 | 5/1971 | Longo | 100/250 |
| 3,693,629 | 9/1972 | Broughton | 131/111 |
| 3,766,929 | 10/1973 | Roman Sr. | 131/119 |
| 3,899,587 | 6/1975 | Wharton | 100/250 |

FOREIGN PATENT DOCUMENTS

| | | | |
|---|---|---|---|
| 624 | of 1910 | United Kingdom | 131/111 |

*Primary Examiner*—Stephen Marcus
*Assistant Examiner*—David T. Fidei
*Attorney, Agent, or Firm*—Walker & McKenzie

[57] ABSTRACT

A snuff holding and dispensing apparatus including a body member having a hollow interior divided into a holding area for holding a quantity of snuff and a dispensing area for receiving a plug of snuff from the quantity of snuff in the holding area, and a plunger movable between a load position for allowing the plug of snuff to pass from the holding area to the dispensing area and a discharge position for dispensing the plug of snuff through a discharge opening in the body member. The plunger coacts with passage structure between the holding and dispensing areas of the interior of the body member to form a sharp slicing mechanism to slice the plug of snuff from the quantity of snuff as the plunger moves from the load position to the discharge position.

5 Claims, 11 Drawing Figures

SNUFF HOLDER AND DISPENSER

BACKGROUND OF THE INVENTION

1. Field of the Invention

The present invention relates, in general, to a device for holding and dispensing snuff.

2. Description of the Prior Art

Various devices have heretofore been developed that relate to holding tobacco products or the like. See, for example, the following U.S. patents: U.S. Pat. No. 1,769,550 granted to Schnabel; U.S. Pat. No. 2,625,937 granted to Sperry; U.S. Pat. No. 3,570,659 granted to Richey; U.S. Pat. No. 1,379,344 granted to Jackson; U.S. Pat. No. 447,615 granted to Lewis; and U.S. Pat. No. 29,387 granted to Kurth et al.

None of the above patents disclose or suggest the present invention.

SUMMARY OF THE INVENTION

The concept of the present invention is to provide a device that will sanitarily hold and dispense snuff. The holder includes a hollow body member having an access opening and an outlet opening, a door means selectively movable between an open position in which the access opening is open and a closed position in which the access opening is closed, a closure member pivotally movable between an open position in which the outlet opening is open and a closed position in which the outlet opening is obstructed, and a plunger means movable between a retracted position and an extended position for the dispensing of the snuff from the hollow body member.

One object of the present invention is to provide a holder to keep the snuff fresh.

Another object of the present invention is to provide a sanitary method to dip snuff.

Still another object of the present invention is to eliminate waste by spillage of the snuff when dipping.

Still another object is to provide a holder for snuff that can be easily carried in any pocket.

DESCRIPTION OF THE PREFERRED EMBODIMENT

Figure 1:
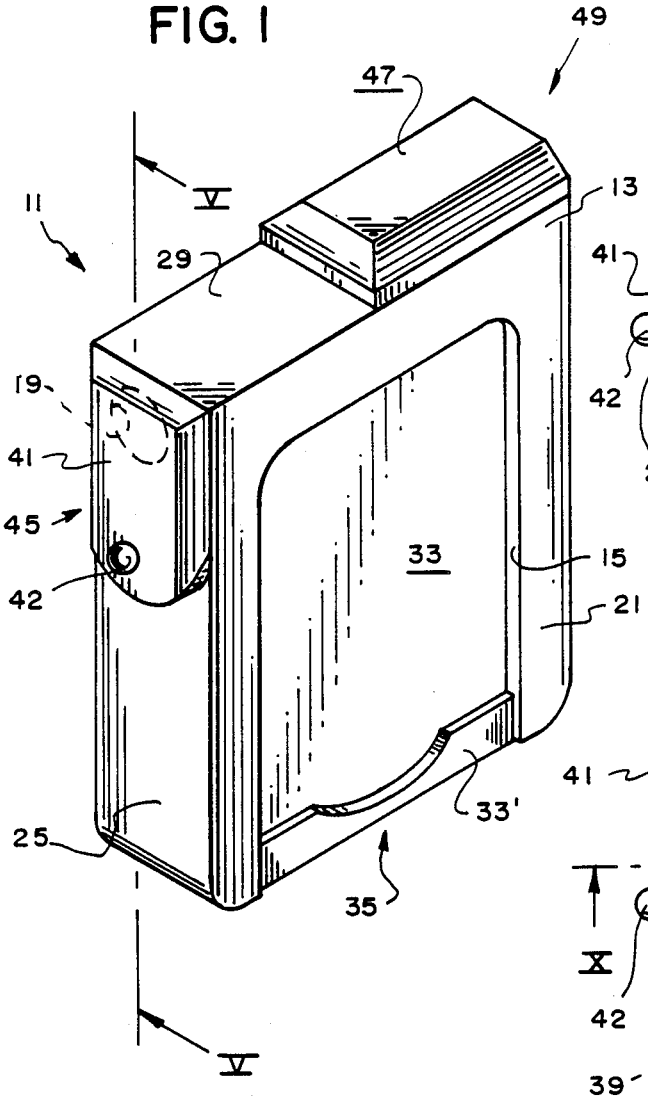
FIG. 1 is a perspective view of the holder of the present invention.
Figure 2:
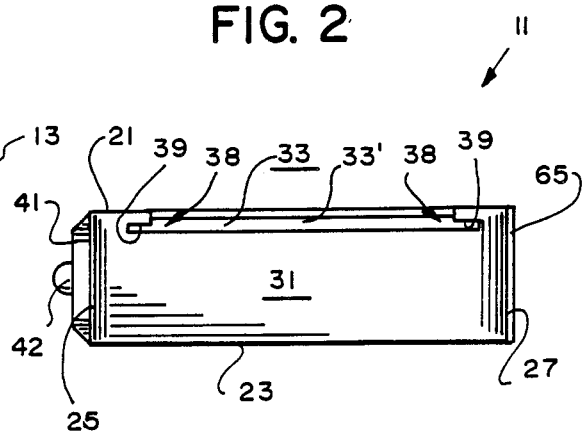
FIG. 2 is a bottom plan view thereof.

The holder 11 of the present invention is for holding and dispensing snuff.

Looking, in general, at FIGS. 1 thru 4, the holder 11 includes a body member 13 having an access opening 15 for access into a hollow interior 17 for allowing snuff to be placed within the hollow interior 17 and having an outlet opening 19 which provides a passage for removing the snuff from the hollow interior 17 thereof. The body member 13 is defined by a box-like container including a front wall member 21 in which access opening 15 is provided, a back wall member 23, a first side wall member 25, a second side wall member 27, a top member 29 and a bottom member 31 with the edges of the various members joined together to form a rigid unit. The specific construction of the body member 13 may vary as will be apparent to those skilled in the art. For example, the body member 13 may be molded out of an acrylic plastic or the like. More specifically, the front wall member 21, back wall member 23, first side wall member 25, second side wall member 27, top member 29 and bottom member 31 may be injection molded as a one-piece integral unit out of acrylic plastic or the like.

Figure 3:
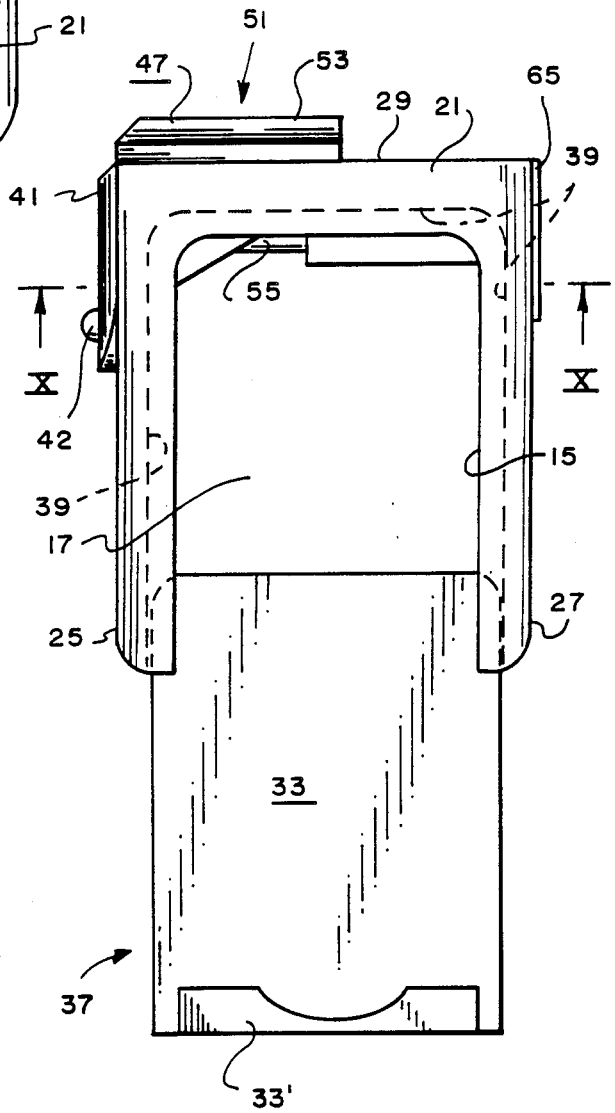
FIG. 3 is a front elevational view thereof shown with the door means in an open position and the plunger means in the extended position.

The holder 11 includes a door means 33 slidably mounted in the front wall member 21 of the body member 13 for movement between a closed position 35 (see FIG. 1) in which the access opening 15 is obstructed and an open position 37 in which the access opening 15 is open (see FIG. 3). The door means 33 may consist of simply a flat plate-like member having a raised portion 33' at one end for a thumb hold to move the door means 33 from a closed position 35 to an open position 37. Guide means 38 are preferably provided in the front wall member 21 of the body member 13 for guiding the door means 33 between a closed position 35 (shown in FIG. 1) and an open position 37 (shown in FIG. 3). The guide means 38 may simply consist of a channel member 39 cut into the front wall member 21 and running around the periphery of the access opening 15 of the body member 13. The channel member 39 is constructed in a manner well known to those skilled in the art so as to guidingly constrain the door means 33 when forceably moved between a closed position 35 and an open position 37.

Figure 4:
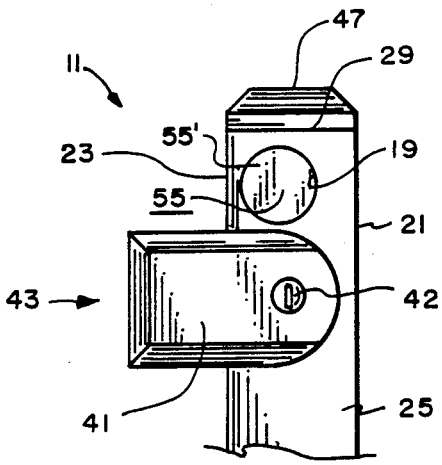
FIG. 4 is a left side elevational of a portion of the body thereof showing the closure member in the open position.
Figure 5:
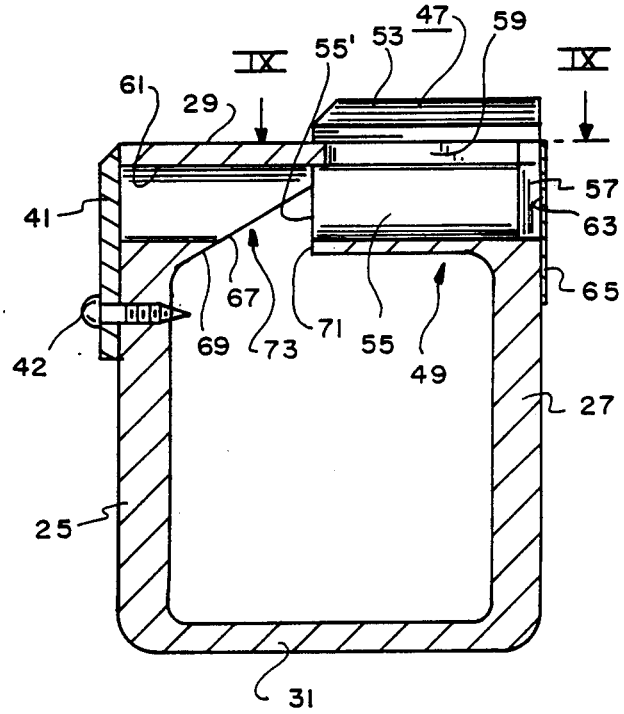
FIG. 5 is a sectional view substantially as taken on line V—V of FIG. 1.

The holder 11 includes a closure member 41 pivotally attached by a pivoting member 42 extending through and into the upper portion of the first side member 25 of the body member 13 (see FIG. 5). The closure member 41 is constructed simply of a small sheet of acrylic plastic which has a pivoting member 42 which may simply consist substantially of a typical screw or the like of well-known construction. The closure member 41 is preferably attached to the upper portion of the first side wall member 25 by pivoting member 42 for movement between an open position 43 in which the outlet opening 19 is opened (see FIG. 4) and a closed position 45 in which the outlet opening 19 is obstructed (see FIG. 1). The closure member 41 is also used as a backing means whose use will hereinafter become apparent.

Figure 6:
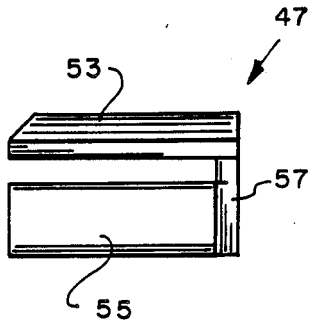
FIG. 6 is a front elevational view of the plunger means of the present invention.
Figure 7:
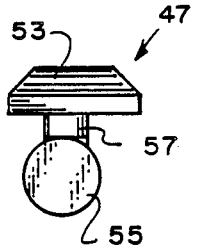
FIG. 7 is a left side elevational view thereof.
Figure 8:
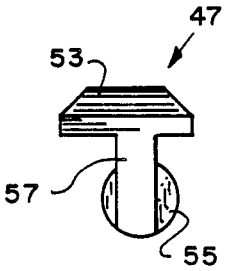
FIG. 8 is a right side elevational view thereof.
Figure 11:
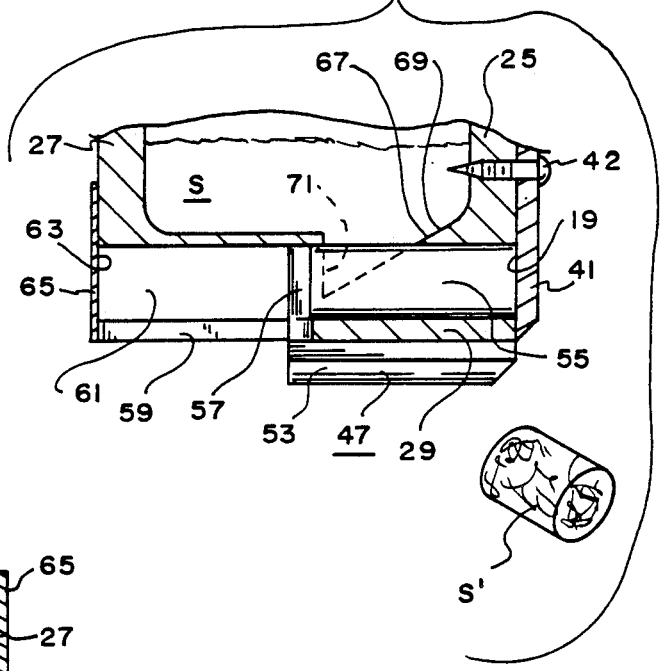
FIG. 11 is a sectional view similar to FIG. 5 but with the body member turned upside down with the plunger means in the extended position.

The holder 11 includes a plunger means 47 movably mounted between a retracted position 49 (see FIGS. 1 and 5) and an extended position 51 (see FIGS. 3 and 11). Plunger means 47 includes an elongated flat head 53 horizontally positioned above the top member 29 of the body member 13, a cylindrical plug 55 horizontally positioned in spaced relationship below the top member 29 thereof and parallel with the head 53, and an upwardly extending leg 57 rigidly connecting the head 53 and plug 55 together (see FIGS. 6 thru 8). The plunger means 47 may be injection molded as a one-piece unit out of acrylic plastic or the like.

Figure 9:
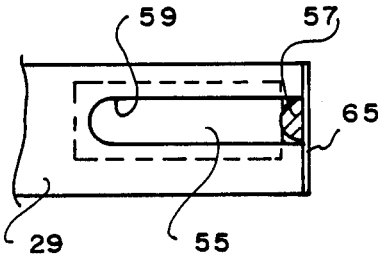
FIG. 9 is a top plan view of a portion of the top member of the body member showing the slot therein.

The top member 29 has an elongated slot 59 cut vertically through the end of top member 29 adjacent the second side wall member 27 and from where slot 59 extends substantially halfway across top member 29 toward the first side wall member 25. The use of the slot 59 will hereinafter become apparent (see FIG. 9).

The body member 13 includes a cylindrical bore 61 extending from the outlet opening 19 in the first side wall member 25 thereof and extending longitudinally through the opposite second side wall member 27 (see FIGS. 5 and 11). The cylindrical bore 61 extends parallel at a spaced distance below the top member 29 and receives the plug 55 of the plunger means 47. Plug 55 is arranged in bore 61 so that the leg 57 is positioned next to the second side wall member 27 and extends upwardly through the slot 59 in the top member 29 with the head 53 extending horizontally above the top member 29 (as shown in FIG. 5). The slot 59 allows the plunger means 47 to slidably move longitudinally between a retracted position 49 in which the plunger means 47 is positioned next to the second side wall member 27 (see FIG. 5) and an extended position 51 in which the plunger means 47 is positioned next to the first side wall member 25 with the plug 55 substantially touching the closure member 41 (see FIGS. 3 and 11). The opening 63 opposite the outlet opening 19, which is the other end of the cylindrical bore 61, is sealed off by a small sheet 65 of acrylic plastic adhered to the second side wall member 27 by an adhesive (not shown) of the type well known to those skilled in the art. The sheet 65 keeps the plunger means 47 from being removed from the cylindrical bore 61.

Figure 10:
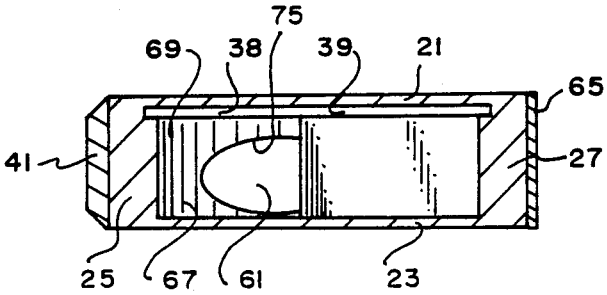
FIG. 10 is a sectional view substantially as taken on line X—X of FIG. 3.

The holder 11 preferably includes a bias means 67 for regulating the amount of snuff falling into the bore 61. The bias means 67 is defined by an inclined flat surface 69 which extends inwardly and upwardly from the inner upper portion of first side wall member 25 at an angle relative thereto, interrupting or cutting away a portion of the cylindrical bore 61 and extending to a place adjacent top member 29 (see, in general, FIGS. 5, 10 and 11). Inclined surface 69 is disposed at a 30° angle relative to top member 29 and cylindrical bore 61. A vertical surface 71 depends from the upper end of inclined surface 69 and cuts downwardly across cylindrical bore 61 to establish with inclined surface 69 a notch-like opening or passage 73 from interior 17 into cylindrical bore 61 when plunger means 47 is in the retracted position 49. The end 55′ of plug 55 is preferably flush with surface 71 when the plunger means 47 is in the retracted position. The intersection of inclined surface 69 with cylindrical bore 61 establishes a generally elliptical edge 75 (see FIG. 10) which is preferably sharp for a purpose to be hereinafter described.

The inclined surface 69 regulates the amount of snuff that falls into the cylindrical bore 61. More specifically, when the holder 11 is used the holder 11 is turned upside down as shown substantially in FIG. 11 allowing the snuff "S" that is enclosed within the interior 17 of the body member 13 to fall downwardly through passage 73 filling up the exposed cylindrical bore 61 to the left of the plug 55, as viewed in FIG. 5 (i.e., the space between the plug 55 and closure member 41). Then as the plunger means 47 is longitudinally moved from the retracted position 49 into the extended position 51, the plug 55 travels within the bore 61 causing a portion of snuff "S" to be substantially sliced by the plug 55 forcing snuff "S" past the sharp edge 75 of the bias means 67. The snuff "S" in front of the plug 55 is formed and compressed against the back of closure member 41 into a substantially cylindrical plug of snuff S′. When the desired amount of snuff "S" is compressed within the bore 61, the closure member 41 is pivoted from the normally closed position 45 to the open position 43 and the plug of snuff S′ is pushed from the bore 61 into the mouth of the user by slidably moving the plunger means 47 to the full extended position 51. When the plug of snuff S′ is compressed, the body member 13 may be inverted allowing easier access to the user's mouth (being placed substantially as shown in FIG. 4). If a bigger plug of snuff S′ is desired, the filling process is simply repeated until the desired size of plug S′ is obtained. In other words, in the filling operation above described, a plug of snuff S′ may be formed in cylindrical bore 61 against the inside of closure member 41. Then while the closure member 41 remains closed and with the plug of snuff S′ in cylindrical bore 61, the plunger means 47 is moved to the retracted position 49. Then, with the holder 11 turned upside down, more snuff "S" is shaken down through passage 73 in behind the first plug of snuff, which is then compressed against the first plug and so on until the desired size of snuff plug S′ is formed.

As thus constructed and used, the holder 11 provides a means to sanitarily carry and dip snuff without the waste and spillage that normally occurs when dipping snuff. Also, the holder 11 allows the user to dip snuff while operating a motorized vehicle or the like.

Although the present invention has been described and illustrated with respect to a preferred embodiment and a preferred use thereof, it is not to be so limited since changes and modifications can be made therein which are within the full intended scope of the invention.

I claim:

1. A holder for the storing and dispensing of snuff, said holder comprising:

(a) body means having an interior for storing snuff and having an outlet opening leading from said interior to the outside of said body means, said body means including a bore communicated with said outlet opening, said bore being interrupted along a portion thereof to provide a passage from said interior to said bore;

(b) closure means for movement into a closed position in which said outlet opening is obstructed and an open position in which said outlet opening is opened;

(c) plunger means including a plug slidably mounted in said bore for compressing the snuff in said bore against said closure means when in said closed position and for dispensing the snuff when said closure means is in said open position; and (d) sharp slicing bias means adjacent said bore for slicing the snuff as the snuff enters said bore from said interior during the movement of said plunger to compress the snuff, whereby a plug of snuff is formed.

2. The holder of claim 1 in which said bias means includes an inclined surface intersecting said bore.

3. The holder of claim 2 in which said inclined surface is disposed at a 30° angle relative to said bore.

4. The holder of claim 3 in which said inclined surface provides a sharp edge at the intersection of said inclined surface and said bore.

5. The holder of claim 14 in which said edge is substantially elliptical in shape.

* * * * *